US006092330A

United States Patent [19]

Pratt

[11] Patent Number: 6,092,330

[45] Date of Patent: Jul. 25, 2000

[54] MEMORIAL YEAR ROUND FLOWER DISPLAY

[76] Inventor: Robert Pratt, P.O. Box 2505, Ceres, Calif. 95307

[21] Appl. No.: 09/156,591

[22] Filed: Sep. 18, 1998

[51] Int. Cl.[7] ..... A01G 5/00; A01G 1/00; E02D 19/00

[52] U.S. Cl. ..... 47/41.1; 47/41.01; 47/33; 27/30

[58] Field of Search ..... 47/41.01, 41.11, 47/41.12, 41.13, 41.14, 41.15, 41.1, 33, 66.7, 83, 86, 87; 27/26–30

[56] References Cited

U.S. PATENT DOCUMENTS

| | | | |
|---|---|---|---|
| D. 116,818 | 9/1939 | Dreher | 47/41.01 |
| 502,595 | 8/1893 | St. George | 47/41.1 |
| 877,145 | 1/1908 | Waddell | 47/41.1 |
| 1,439,143 | 12/1922 | Buss | 47/41.1 |
| 1,541,983 | 6/1925 | McGowan | 47/41.01 |
| 1,616,647 | 2/1927 | Berger | 47/41.01 |
| 1,717,576 | 6/1929 | Miller | 47/41.01 |
| 1,784,621 | 12/1930 | Boyer | 47/41.1 |
| 1,899,400 | 2/1933 | Shaw | 47/41.1 |
| 1,973,868 | 9/1934 | Field | 47/41.11 |
| 1,981,640 | 11/1934 | Baker et al. | 47/41.1 |
| 1,995,771 | 3/1935 | Grueneberg | 47/41.1 |
| 2,075,441 | 3/1937 | Joseph | 47/41.01 |
| 2,255,277 | 9/1941 | Bronson | 47/41.1 |
| 2,436,631 | 2/1948 | Cohn | 47/41.1 |
| 2,488,924 | 11/1949 | Meierjohan et al. | 47/41.1 |
| 2,610,443 | 9/1952 | Carlson | 47/41.1 |
| 2,638,717 | 5/1953 | Weaver | 47/41.01 |
| 2,710,491 | 6/1955 | Carlson | 47/41.1 |
| 2,754,625 | 7/1956 | Rasmussen | 47/41.1 |
| 3,190,039 | 6/1965 | Carlson | 47/41.1 |
| 3,302,326 | 2/1967 | Maino | 47/41.1 |
| 3,377,043 | 4/1968 | King | 47/41.1 |
| 3,434,235 | 3/1969 | Gordon et al. | 47/41.1 |
| 3,541,727 | 11/1970 | Carlson | 47/41.1 |
| 4,306,376 | 12/1981 | Strassacker | 47/41.1 |
| 4,893,385 | 1/1990 | Schrag | 27/35 |
| 5,469,654 | 11/1995 | Thompson | 47/41.12 |

FOREIGN PATENT DOCUMENTS

| | | | |
|---|---|---|---|
| 340489 | 5/1904 | France | 47/41.11 |
| 1204007 | 10/1965 | Germany | 47/41.1 |
| 1297396 | 6/1969 | Germany | 47/41.1 |
| 2301018 | 7/1974 | Germany | 47/41.1 |
| 2701497 | 7/1978 | Germany | 47/41 R |
| 3826334 | 12/1989 | Germany | 47/41.13 |
| 4009633 | 10/1991 | Germany | 47/41.01 |
| 4313069 | 10/1994 | Germany | 47/41.01 |
| 53922 | 10/1910 | Switzerland | 47/41.1 |
| 3261 | 2/1893 | United Kingdom | 47/41.11 |
| 8788 | 5/1894 | United Kingdom | 47/41.11 |
| 5989 | 12/1910 | United Kingdom | 47/41.1 |
| 291181 | 5/1928 | United Kingdom | 47/41.1 |
| 291915 | 6/1928 | United Kingdom | 47/41.11 |
| 296583 | 9/1928 | United Kingdom | 47/41.11 |
| 335981 | 10/1930 | United Kingdom | 47/41.13 |
| 2176399 | 12/1986 | United Kingdom | 47/41.12 |

OTHER PUBLICATIONS

"The Matthews Memorial Service (International)", (Matthews), an advertisement, Nov. 1933.

*Primary Examiner*—Michael J. Carone
*Assistant Examiner*—Fredrick T. French, III
*Attorney, Agent, or Firm*—Eric Karich

[57] ABSTRACT

A memorial flower display has a receptacle shaped to receive a flower vase. The flower vase has a plurality of engagement studs that engage mating stud receiving channels in the receptacle. The stud receiving channels each have a top slot. When the engagement studs are in the top slots, the flower vase in held in a raised position. When the user twists the flower vase with an upwardly extending handle integral with the flower vase, the engagement studs are twisted out of the top slots, allowing the engagement studs to slide down the stud receiving channels, thereby allowing the flower vase to be lowered into the receptacle to a lowered position. The memorial flower display preferably is covered with a base plate to secure the memorial flower display against theft. The base plate preferably further includes a pair of closure plates that can be moved to cover the memorial flower display for protection.

13 Claims, 3 Drawing Sheets fig. 4
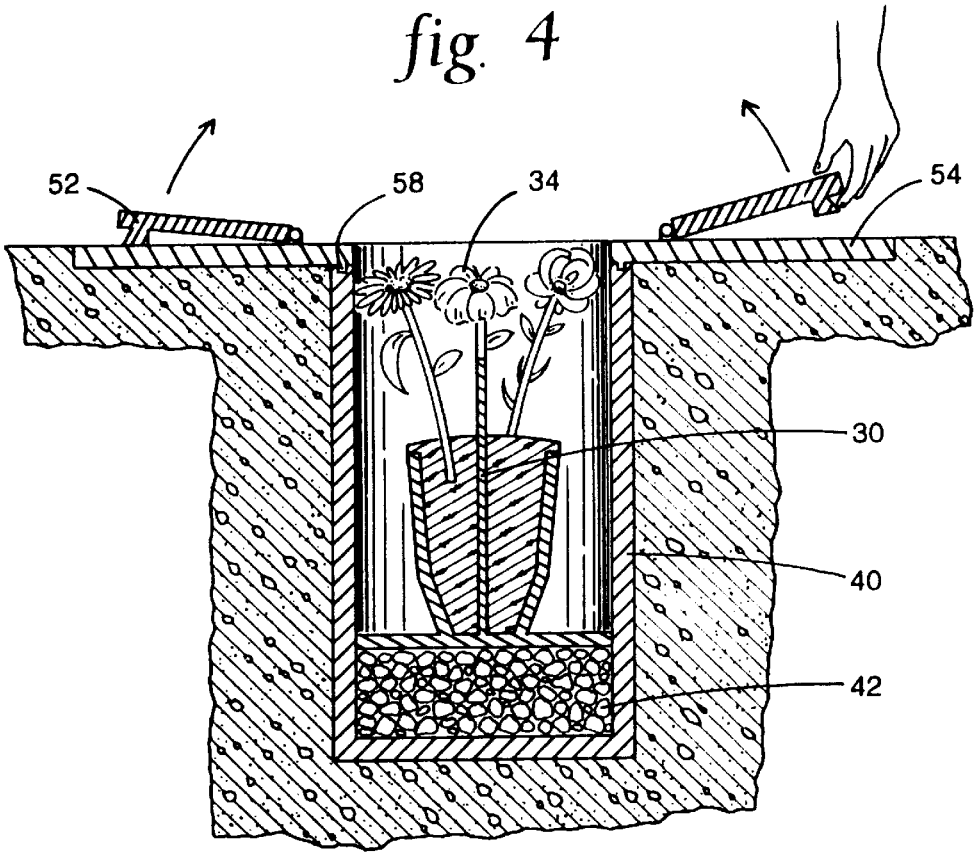
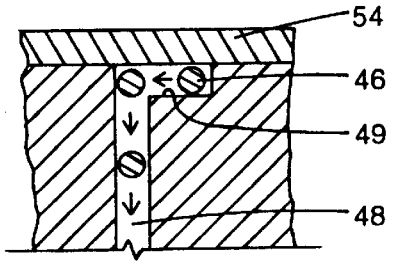
fig. 5
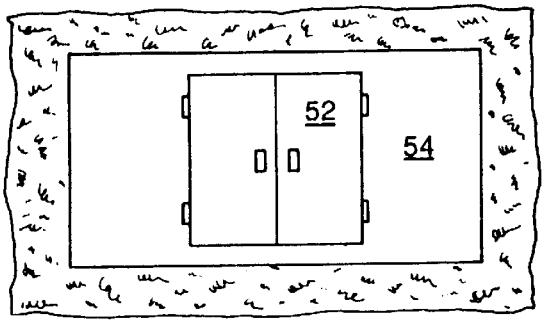
fig. 6

MEMORIAL YEAR ROUND FLOWER DISPLAY

BACKGROUND OF THE INVENTION

1. Field of the Invention

This invention relates generally to flower displays in cemeteries, and more particularly to a flower display that can be lowered into an underground chamber to facilitate mowing the cemetery, the flower display having the unique ability to be lowered into the underground chamber without requiring the removal of the flowers.

2. Description of Related Art

The prior art discloses a flower vase for use in cemeteries that can be stored under ground. Most of the prior art consists of a vase that can be inverted and placed in an underground chamber. Examples of this structure include Joseph, U.S. Pat. No. 2,075,441, Miller, U.S. Pat. No. 1,717,576, Berger, U.S. Pat. No. 1,616,647, McGowan, U.S. Pat. No. 1,541,983, and Dreher, U.S. Des. Pat. No. 116,818. An alternative structure is disclosed in Weaver, U.S. Pat. No. 2,638,717, in which the vase rotates 90 degrees so the vase lies in the ground sideways. The disadvantage of these vases is that the contents of the vase must be discarded whenever the cemetery gardener mows the lawn.

The most advanced invention, disclosed in Strassacker, U.S. Pat. No. 4,306,376, is a countersunk vase that lowers into the ground in an upright orientation. This allows the vase to remain full of water, allowing new flowers to be easily added after the gardener has mowed the cemetery lawn. However, the structure disclosed in Strassacker does not have a handle and it does not lower into the ground far enough to allow the gardener to leave the flowers in the vase.

The prior art teaches flower vases that can be stored under ground. However, the prior art does not teach a flower vase that can be easily lowered and stored under ground without discarding the flowers contained within the flower vase. The present invention fulfills these needs and provides further related advantages as described in the following summary.

SUMMARY OF THE INVENTION

The present invention teaches certain benefits in construction and use which give rise to the objectives described below.

The present invention provides a memorial flower display of the type used for graves. The memorial flower display of this invention includes a receptacle shaped to receive a flower vase. The flower vase has an upwardly extending handle that operatively controls a positioning means. The positioning means cooperates with the receptacle to either hold the flower vase in a raised position, or allow the flower vase to be lowered into the receptacle to a lowered position. In its preferred embodiment, the memorial flower display further includes a closure means that serves to secure the memorial flower display against theft as well as cover the flower vase to facilitate driving a lawn mover over the memorial flower display.

A primary objective of the present invention is to provide memorial flower display of the type used for graves having advantages not taught by the prior art.

Another objective is to provide a memorial flower display that can be easily lowered and stored under ground without discarding the flowers contained within the flower vase.

Another objective is to provide a memorial flower display that does not contain pools of water, avoiding problems with mosquitoes.

A further objective is to provide a memorial flower display having artificial flowers that can be changed seasonally.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 4 is a side elevational sectional view showing the flower vase in the lowered position;

FIG. 5 is a sectional view thereof taken along line 5—5 in FIG. 3; and FIG. 6 is a top plan view thereof showing two closure plates covering a round hole of the base plate thereby sealing the flower vase within the receptacle.

DETAILED DESCRIPTION OF THE INVENTION

Figure 1:
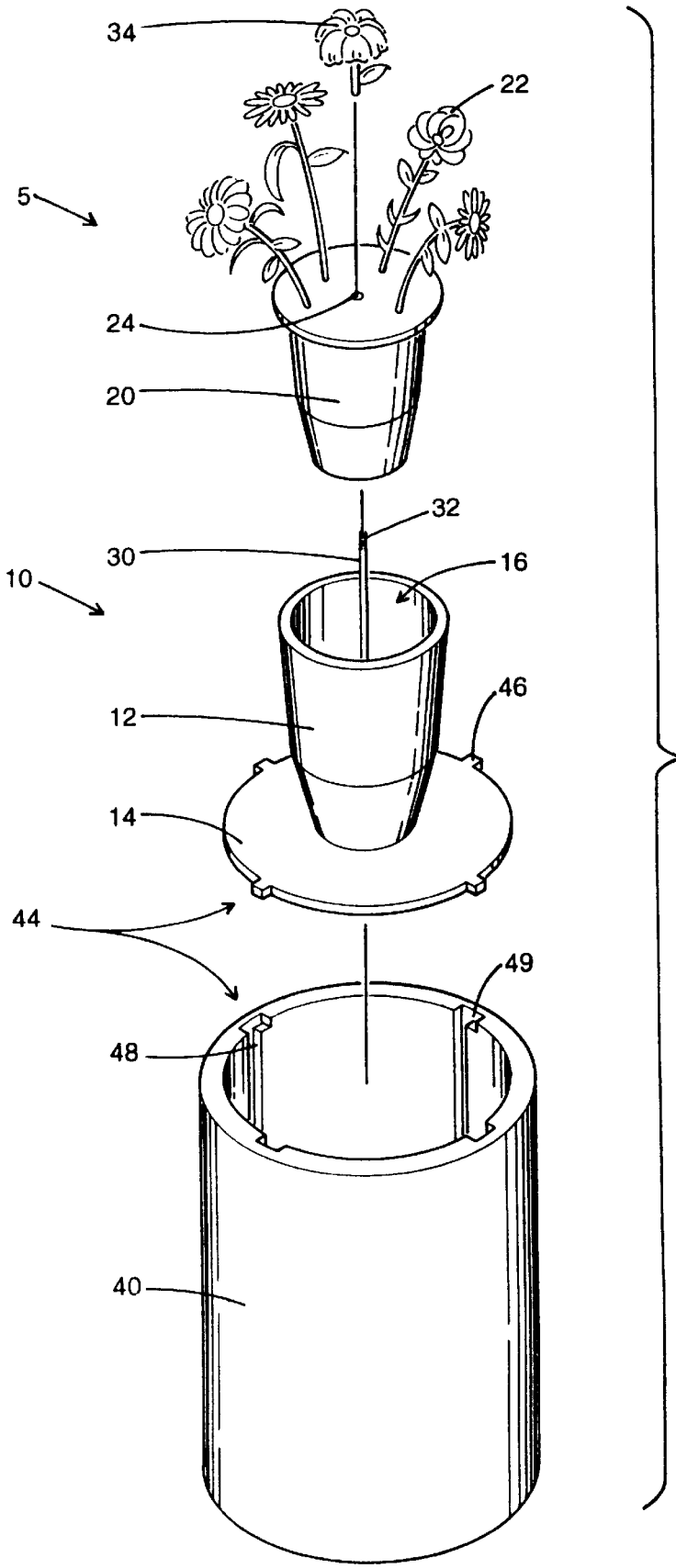
FIG. 1 is an exploded perspective view of the present invention.
Figure 2:
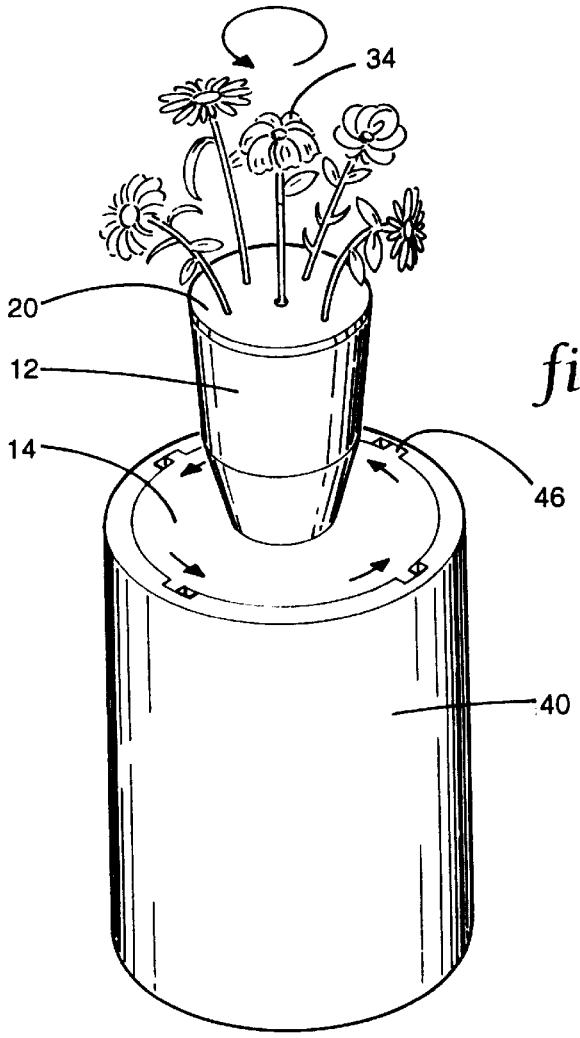
FIG. 2 is a perspective view thereof, showing a flower vase in a raised position on a receptacle.
Figure 3:
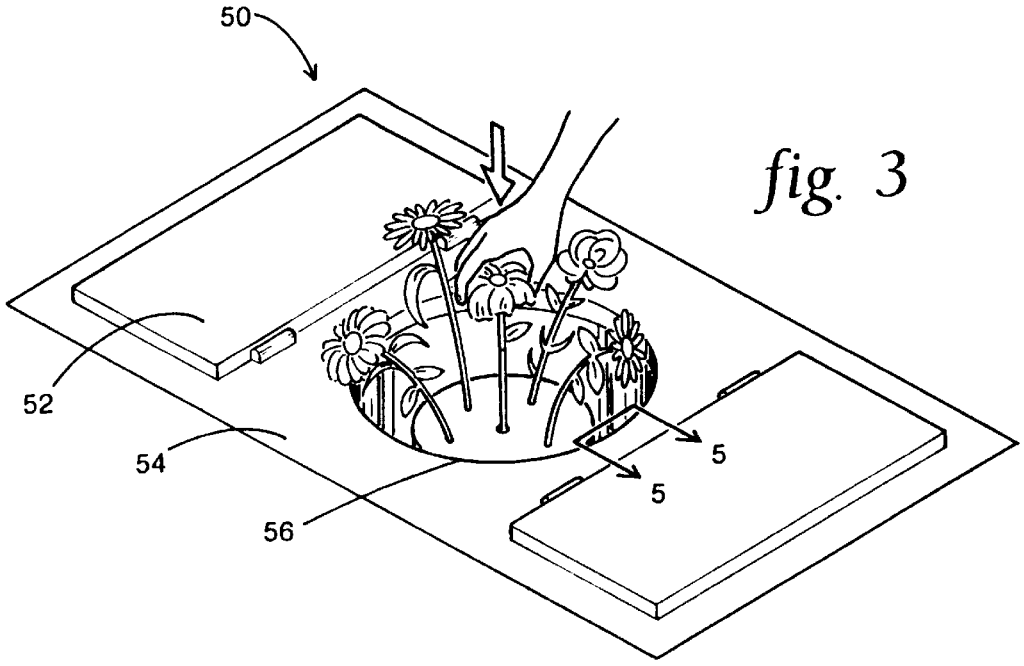
FIG. 3 is a plan view thereof further showing a base plate covering the receptacle, and showing the flower vase being lowered into the receptacle.

The above described drawing figures illustrate the invention, a memorial flower display 5 of the type used for graves. The memorial flower display 5 of this invention includes a receptacle 40 shaped to receive a flower vase 10. The flower vase 10 has an upwardly extending handle 30 that operatively controls a positioning means 44. The positioning means 44 cooperates with the receptacle 40 to either hold the flower vase 10 in a raised position, or allow the flower vase 10 to be lowered into the receptacle 40 to a lowered position. It is critical that the flower vase 10 and its contents, preferably artificial flowers 22, are completely protected within the receptacle 40 when the flower vase 10 is moved to the lowered position. The upwardly extending handle 30 allows the user to easily move the flower vase 10 to the lowered position, as well as raise the flower vase 10 to the raised position once the cemetery has been mowed. In its preferred embodiment, the memorial flower display 5 further includes a closure means 50 described below. The closure means 50 serves to secure the memorial flower display 5 against theft as well as cover the flower vase 10 to facilitate driving a lawn mover over the memorial flower display 5 without damaging the memorial flower display 5 or the lawn mower.

In FIG. 1 a flower vase 10 designed according to the preferred embodiment of the invention is shown as part of an exploded perspective view of the entire memorial flower display 5. A side elevational sectional view of the flower vase 10 is shown in FIG. 4 showing the preferred structure of the flower vase 10. The flower vase 10 preferably includes a cylindrical vase sidewall 12 connected at the bottom by a vase base 14. The vase sidewall 12 and vase base 14 together defining a flower receiving space 16. The flower vase 10 is made of a relatively rigid and durable material that is inexpensive to manufacture, preferably molded plastic; although more expensive variants of the invention would be made of bronze or similar metal. Various structures somewhat similar are disclosed in Joseph, U.S. Pat. No. 2,075,441, Miller, U.S. Pat. No. 1,717,576, Berger, U.S. Pat. No. 1,616,647, McGowan, U.S. Pat. No. 1,541,983, Dreher, U.S. Des. Pat. No. 116,818, Weaver, U.S. Pat. No. 2,638,717, and Strassacker, U.S. Pat. No. 4,306,376, herein incorporated by reference in full. The mourners can fill the flower receiving space 16 with any flowers they desire; however, in the preferred embodiment, the memorial flower display 5 further includes a foam base 20 having a plurality of artificial flowers 22 extending therefrom. The foam base 20 is positioned within the flower receiving space 16 of the flower vase 10. Different foam base 20 elements having different arrangements of artificial flowers 22 can be used interchangeably, depending on the desires of the mourners and the season.

The upwardly extending handle 30 and the positioning means 44 are preferably an integral part of the molded plastic flower vase 10. As shown in FIG. 4, the upwardly extending handle 30 preferably is a rod extending from the center of the vase base 14 through the flower receiving space 16. As shown in FIGS. 1 and 4, the foam base 20 described above preferably includes a central conduit 24 through which fits the upwardly extending handle 30. As shown in FIG. 1, the upwardly extending handle 30 preferably has a threaded end 32 for threadedly engaging a bronze flower shaped knob 34. The flower shaped knob 34, having a diameter greater than the diameter of the central conduit 24, removably engages the upwardly extending handle 30 and thereby locks the foam base 20 to the flower vase 10. The flower shaped knob 34 also presents the user with a convenient handle with which to twist the flower vase 10, as described below.

The receptacle 40, as shown in FIGS. 1 and 4, is preferably a cylindrical silo made of PVC, rubber or plastic. The receptacle 40 preferably is partially filled with drainage rocks 42 such as gravel to allow any water that leaks into the receptacle 40 to filter out and not allow mosquitoes to flourish. The receptacle 40 is sized to accept the flower vase 10 in conjunction with the positioning means 44. The positioning means 44 is a structure that allows the user to manipulate the flower vase 10 with respect to the receptacle 40, allowing the flower vase 10 to be raised or lowered. Those skilled in the art can devise various mechanisms to act as a positioning means 44. In the preferred embodiment, the positioning means 44 includes two mating elements: first, the positioning means 44 includes at least two engagement studs 46 integral with and extending from the vase base 14 of the flower vase 10 to slidably engage mating stud receiving channels 48 that run the vertical length of the receptacle 40. The stud receiving channels 48 each have a top slot 49 that is shown in FIG. 5. When the flower vase 10 is in the raised position, the engagement studs 46 of the flower vase 10 rest on the top slot 49, thereby supporting the flower vase 10. When the cemetery gardener wants to lower the flower vase 10 to mow that part of the cemetery, he simply grasps the upwardly extending handle 30, preferably by the flower shaped knob 34, and twists the flower vase 10 until the engagement studs 46 fall into their mating stud receiving channels 48, allowing the flower vase 10 to fall into the receptacle 40 until the vase base 14 rests on the drainage rocks 42 at the bottom of the receptacle 40. The flower vase 10 is never upended in this process, and it drops far enough under the ground that the artificial flowers 22 in the flower vase 10 do not have to be removed before the gardener can mow over the memorial flower display 5.

The memorial flower display 5 preferably further includes a closure means 50. The closure means 50 includes a base plate 54 having a round hole 56. The round hole 56 has a diameter that is larger than the circumference of the vase sidewall 12, smaller than the vase base 14, and at least as small as the diameter of the receptacle 40. The base plate 54 is mounted over and secured to the receptacle 40 with mating nipples 58, thereby locking the receptacle 40 and the flower vase 10 in place. The base plate 54 serves as an anti-theft device, preventing anyone from removing the flower vase 10 or the receptacle 40. The closure means 50 further including at least one, preferably two, bronze closure plates 52 hingably attached to the base plate 54 The closure plates 52 are hingably mounted on a bronze base plate 54. The closure plates 52 cover the round hole 56 when moved to their closed position, thereby sealing the vase base 14 within the receptacle 40. The closure plates 52 allow the user to close the receptacle 40 when the flower vase 10 in lowered into the lowered position, allowing the cemetery gardener to drive a lawnmower over the memorial flower display 5.

The invention also includes a method for displaying flowers at a gravesite. The method includes providing the elements of the memorial flower display 5 as described above. After digging a hole in the ground large enough to accommodate the receptacle 40, the user positions the receptacle 40 in the hole in the ground such that the rim of the receptacle 40 is just below the surface of the ground. The user then preferably fills the bottom of the receptacle 40 with drainage rocks 42 to prevent water from pooling in the bottom of the receptacle 40 and allowing mosquitoes to grow. The user then rests the flower vase 10 on the top of the receptacle 40 such that the positioning means 44 cooperates with the receptacle 40 to hold the flower vase 10 in a raised position. In this position, in the preferred embodiment, the engagement studs 46 rest on their respective top slots 49. The user then grasps the upwardly extending handle 30 and manipulates the positioning means 44 with the upwardly extending handle 30, causing the positioning means 44 to drop into the receptacle 40. As described above, by twisting the flower shaped knob 34, the user can move the engagement studs 46 from the top slots 49 to the stud receiving channels 48, thereby allowing the flower vase 10 to fall into the receptacle 40. Once the flower vase 10 has been lowered into the receptacle 40 to the lowered position, the closure means 50 can be locked into position.

In its preferred embodiment, the closure means 50 includes a base plate 54 and a pair of closure plates 52. The base plate 54 has a round hole 56. The pair of closure plates 52 are hingably attached to the base plate 54. In their closed position, the closure plates 52 cover the round hole 56. The round hole 56 has a diameter that is larger than the circumference of the vase sidewall 12, smaller than the vase base 14, and at least as small as the diameter of the receptacle 40. The base plate 54 is positioned above the receptacle 40 such that the round hole 56 is co-axially aligned with the receptacle 40. The base plate 54 is then locked to the receptacle 40 with at least two mating nipples 58, thereby sealing the vase base 14 within the receptacle 40 and preventing theft. The closure plates 52, when closed, cover the flower vase 10 to facilitate driving a lawn mover over the memorial flower display 5 without damaging the memorial flower display 5 or the lawn mower.

Once the flower vase 10 has been assembled, the user can insert flowers into the flower vase 10. The user preferably providing a foam base 20 having a plurality of artificial flowers 22 extending therefrom. The foam base 20 is positioned within the flower receiving portion of the flower vase 10 such that the upwardly extending handle 30 fits through a central conduit 24. The user then locks the foam base 20 into place by threadedly engaging a bronze flower shaped knob 34 having a diameter greater than the diameter of the central conduit 24 to the top of the upwardly extending handle 30. The artificial flowers 22 used can be readily changed by the user to correspond with the season.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for displaying a plurality of flowers at a gravesite, the method comprising the steps of:

a flower vase having a vase sidewall connected by a vase base, the vase sidewall and the vase base cooperating to form a flower receiving space for receiving the plurality of flowers, the flower vase further having an upwardly extending handle that extends above the vase sidewall;

positioning the plurality of flowers within the flower receiving space;

providing a receptacle shaped to receive the flower vase, the plurality of flowers, and the upwardly extending handle;

digging a hole in the ground large enough to accommodate the receptacle;

positioning the receptacle within the hole;

resting the flower vase on the top of the receptacle such that the positioning means cooperates with the receptacle to hold the flower vase in a raised position, thereby displaying the flowers;

grasping the upwardly extending handle;

manipulating the positioning means with upwardly extending handle, causing the flower vase to drop into the receptacle; and lowering the flower vase into the receptacle to a lowered position, until the flower vase, the flowers, and the upwardly extending handle are within the receptacle.

2. The method of claim 1 further comprising the steps of:

filling the bottom of the receptacle with drainage rocks.

3. The method of claim 1 further comprising the steps of:

providing a foam base having a plurality of artificial flowers extending therefrom; and positioning the foam base within the flower vase.

4. The method of claim 1 further comprising the steps of:

providing a foam base having a plurality of artificial flowers extending therefrom;

positioning the foam base within the flower vase such that the upwardly extending handle fits trough a central conduit of the foam base;

providing a flower shaped knob having a diameter greater than the diameter of the central conduit; and removably engaging the flower shaped knob to the upwardly extending handle, thereby locking the foam base to the flower vase.

5. The method of claim 1 further comprising the steps of:

providing a base plate having a round hole, the round hole having a diameter that is larger than the circumference of the vase sidewall; having a diameter that is smaller than the vase base; and having a diameter that is at least as small as the diameter of the receptacle;

providing at least one closure plate hingably attached to the base plate;

positioning the base plate above the receptacle such that the round hole is co-axially aligned with the receptacle locking the base plate to the receptacle, thereby sealing the vase base within the receptacle.

6. A memorial flower display of the type used for graves comprising:

a flower vase having a vase sidewall connected by a vase base, the vase sidewall and the vase base cooperating to form a flower receiving space;

an upwardly extending handle that extends from the flower vase, the upwardly extending handle extending above the vase sidewall;

a foam base having a plurality of artificial flowers extending therefrom, the foam base being positioned within the flower receiving space;

a receptacle shaped to receive the flower vase, the plurality of artificial flowers, and the upwardly extending handle; and a positioning means that is operatively controlled by the upwardly extending handle, the positioning means cooperating with the receptacle to either hold the flower vase in a raised position or allow the flower vase to be lowered into the receptacle to a lowered position, the artificial flowers being contained within the receptacle when the flower vase is in the lowered position.

7. The flower display of claim 6 further comprising:

a closure means including a base plate having a round hole, the round hole having a diameter that is larger than the circumference of the vase sidewall, smaller than the vase base, and at least as small as the diameter of the receptacle; and the closure means further including at least one closure plate hingably attached to the base plate, the closure plate covering the round hole when moved to its closed position, thereby sealing the vase base and the artificial flowers within the receptacle.

8. A memorial flower display for displaying flowers, the memorial flower display comprising:

a flower vase having a vase sidewall connected by a vase base, the vase sidewall and the vase base cooperating to form a flower receiving space for receiving the flowers;

an upwardly extending handle that extends from the flower vase, the upwardly extending handle extending above the vase sidewall;

a receptacle shaped to receive the flower vase, the flowers, and the upwardly extending handle; and a positioning means that is operatively controlled by the upwardly extending handle, the positioning means cooperating with the receptacle to either hold the flower vase in a raised position or allow the flower vase to be lowered into the receptacle to a lowered position.

9. The flower display of claim 8 further comprising a foam base having a plurality of artificial flowers extending therefrom, the foam base being positioned within the flower vase.

10. The flower display of claim 9 wherein the foam base includes a central conduit through which fits the upwardly extending handle; and a flower shaped knob removably engages the upwardly extending handle; and the knob, having a diameter greater than the diameter of the central conduit, thereby locks the foam base to the flower vase.

11. The flower display of claim 8 wherein the positioning means includes at least two engagement studs extending from the flower vase to slidably engage mating stud receiving channels in the receptacle.

12. The flower display of claim 8 further comprising a closure means securing the flower vase to the receptacle, as well as closing the flower vase within the receptacle when the flower vase in lowered into the lowered position.

13. The flower display of claim 12 wherein the closure means includes a base plate having a round hole, the round hole having a diameter that is larger than the circumference of the vase sidewall; having a diameter that is smaller than the vase base; and having a diameter that is at least as small as the diameter of the receptacle; and the closure means further includes at least one closure plate hingably attached to the base plate, the closure plate covering the round hole when moved to its closed position, thereby sealing the vase base within the receptacle.

* * * * *